US006943689B2

(12) United States Patent
Kolton et al.

(10) Patent No.: US 6,943,689 B2
(45) Date of Patent: Sep. 13, 2005

(54) ELECTRONIC ARTICLE SURVEILLANCE MARKER ASSEMBLY

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 10/721,520

(22) Filed: Nov. 24, 2003

(65) Prior Publication Data

US 2005/0110643 A1 May 26, 2005

(51) Int. Cl.[7] ..... G08B 13/14
(52) U.S. Cl. ..... 340/572.8; 340/568.1
(58) Field of Search ..... 340/568.1, 571, 340/572.1, 572.8, 572.9, 566; 264/151, 166; 29/602.1, 25.35

(56) References Cited

U.S. PATENT DOCUMENTS 4,774,503 A * 9/1988 Bussard ..... 340/572.9
5,367,289 A * 11/1994 Baro et al. ..... 340/566
5,969,613 A * 10/1999 Yeager et al. ..... 340/572.9
6,092,401 A * 7/2000 Sankey et al. ..... 70/18
6,543,261 B2 * 4/2003 Kolton et al. ..... 70/57.1
6,646,553 B1 * 11/2003 Kolton et al. ..... 340/572.1
6,692,672 B1 * 2/2004 Deschenes et al. ..... 264/151
6,696,955 B2 * 2/2004 Kolton et al. ..... 340/572.8

* cited by examiner

*Primary Examiner*—Van T. Trieu
(74) *Attorney, Agent, or Firm*—Hoffmann & Baron, LLP

(57) ABSTRACT

An electronic article surveillance assembly comprises an upstanding housing having a closed ceiling and a floor having a continuous peripheral portion bounding a central floor opening, the housing having an interior cavity communicating with the central floor opening, an EAS marker being disposed in the housing interior cavity, the housing defining a sidewall extending from the ceiling to the continuous peripheral floor portion and tapered to form the housing with a periphery having a V-shaped cross-section. Further provided is, in combination, an electronic article surveillance assembly comprising an upstanding housing having a closed ceiling and a floor having a continuous peripheral portion bounding a central floor opening, the housing having an interior cavity communicating with the central floor opening, an EAS marker being disposed in the housing interior cavity, the housing defining a sidewall extending from the ceiling to the continuous peripheral floor portion and tapered to form the housing with a periphery having a V-shaped cross-section and an article of manufacture, the continuous floor peripheral portion being secured to an exterior surface of the article of manufacture.

14 Claims, 3 Drawing Sheets

10
24
14
12

10
16
20
22
18
IV
IV
III
III
12
16a 10
18
14
20
12
24

10
18
20
24
12

26

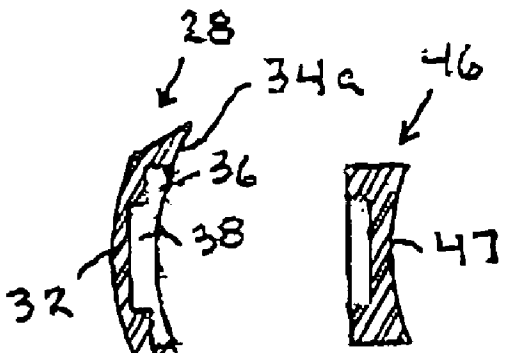
FIG. 9
FIG. 8
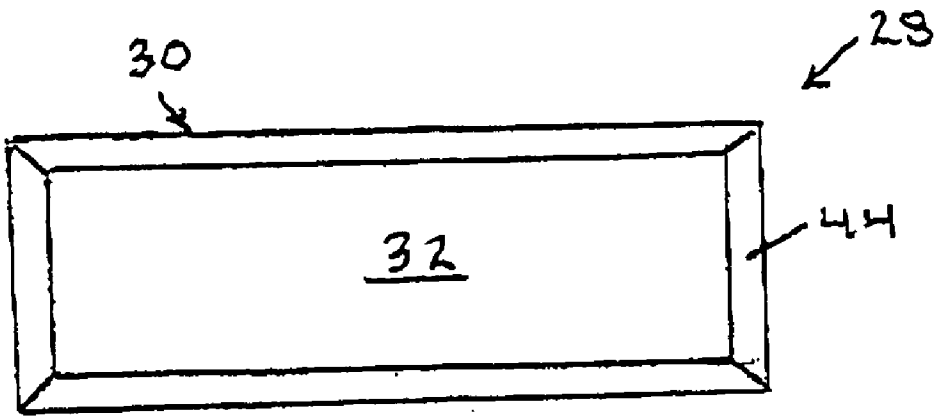
FIG. 6
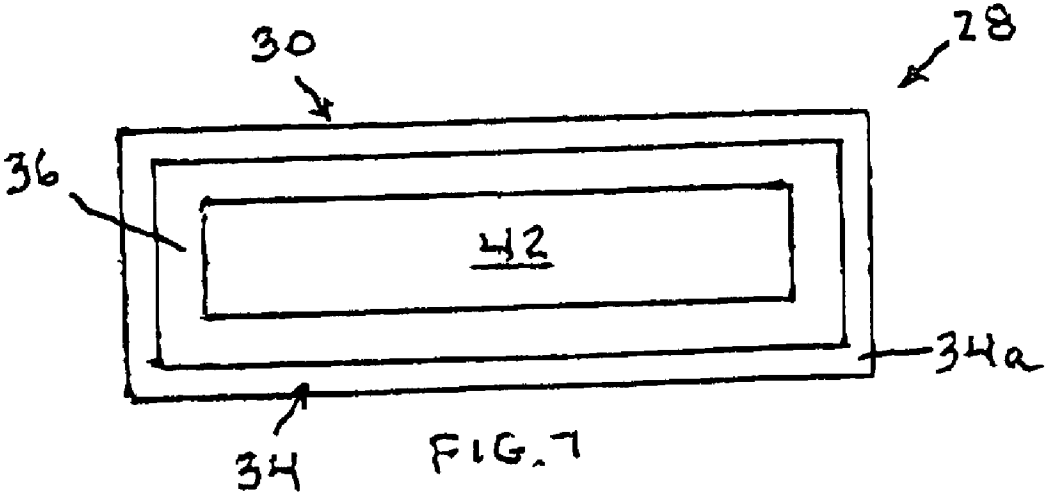
FIG. 7

ELECTRONIC ARTICLE SURVEILLANCE MARKER ASSEMBLY

FIELD OF THE INVENTION

This invention relates generally to security from shoplifting of articles of manufacture and pertains more particularly to electronic article surveillance marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

The EAS marker is a flat ferromagnetic strip member and is detectable by various known EAS systems, e.g., where the marker is not deactivated (as at an article payment checkout counter) and is carried through EAS marker detection gates at a facility exit.

SUMMARY OF THE INVENTION

A primary object of the invention is to provide EAS marker assemblies having enhanced resistance to removal from objects to be thereby protected.

In attaining the foregoing and other objects, the invention provides an electronic article surveillance assembly comprising an upstanding housing having a closed ceiling and a floor having a continuous peripheral portion bounding a central floor opening, the housing having an interior cavity communicating with the central floor opening, an EAS marker being disposed in the housing interior cavity, the housing defining a sidewall extending from the ceiling to the continuous peripheral floor portion and tapered to form the housing with a periphery having a V-shaped cross-section.

The invention further provides, in combination, an electronic article surveillance assembly comprising an upstanding housing having a closed ceiling and a floor having a continuous peripheral portion bounding a central floor opening, the housing having an interior cavity communicating with the central floor opening, an EAS marker being disposed in the housing interior cavity, the housing defining a sidewall extending from the ceiling to the continuous peripheral floor portion and tapered to form the housing with a periphery having a V-shaped cross-section and an article of manufacture, the continuous floor peripheral portion being secured to an exterior surface of the article of manufacture.

The invention will be further understood from consideration of the following description of preferred embodiments thereof and from the drawings where like reference numerals identify like parts throughout.

DESCRIPTION OF THE DRAWINGS

FIG. 6 is a top plan view of a second embodiment of an EAS assembly in accordance with the invention.

FIG. 7 is a bottom plan view of the EAS assembly of FIG. 6.

FIG. 8 is a sectional view of the EAS assembly of FIG. 6 as would be seen from plane VIII—VIII of FIG. 6.

FIG. 9 is a sectional view of a closure member for the EAS assembly of FIG. 6.

DETAILED DESCRIPTION OF THE PREFERRED EMBODIMENTS

Figures 1, 2, 3, 4, 5:
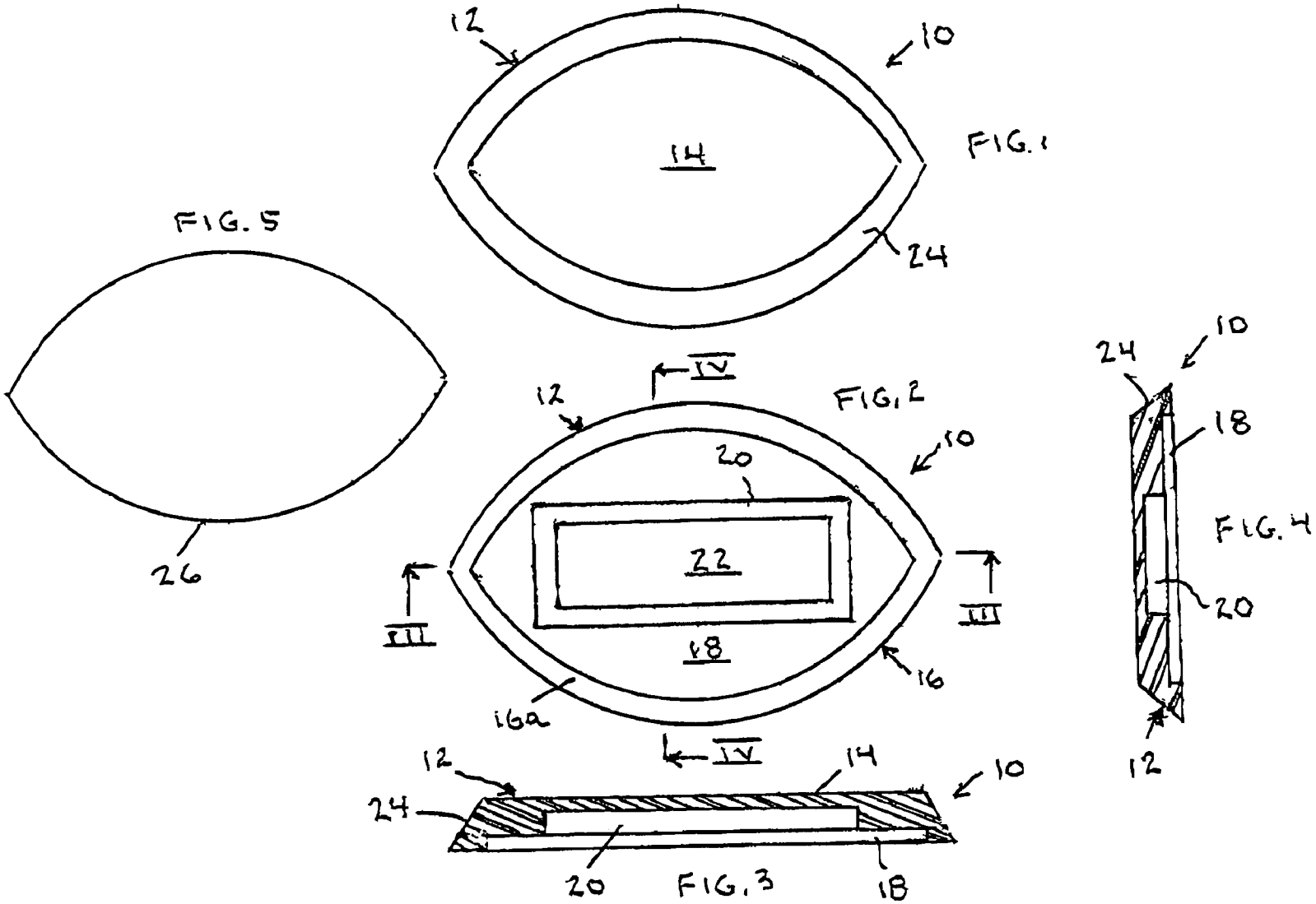
FIG. 1 is a top plan view of an EAS assembly in accordance with the invention.
FIG. 2 is a bottom plan view of the EAS assembly of FIG. 1.
FIG. 3 is a sectional view of the EAS assembly of FIG. 1 as would be seen from plane III—III of FIG. 1.
FIG. 4 is a sectional view of the EAS assembly of FIG. 1 as would be seen from plane IV—IV of FIG. 1.
FIG. 5 is a top plan view of a closure member for the EAS assembly of FIG. 1.

Referring to FIGS. 1–4, electronic article surveillance assembly 10 comprises upstanding housing 12 having closed ceiling 14 and floor 16 having a continuous peripheral portion 16*a*; bounding central floor opening 18.

Housing 12 has an interior cavity 20 communicating with central floor opening 18. EAS marker 22 is disposed in housing interior cavity 20.

Housing 12 defines sidewall 24 extending from ceiling 14 to continuous peripheral floor portion 16*a* and tapered to form the housing with a periphery having a V-shaped cross-section, as is seen particularly in FIGS. 3 and 4.

Bottom closure member 26 is secured to an interior surface of the floor continuous peripheral portion, as by an adhesive or heat sealing. An adhesive layer (not shown) is disposed on the bottom closure member 26 and floor continuous peripheral portion 16*a*.

Turning to FIGS. 6–9, electronic article surveillance assembly 28 comprises upstanding housing 30 having closed ceiling 32 of arcuate configuration and floor 34 having a continuous peripheral portion 34*a*, bounding central floor opening 36, and of common arcuate configuration with ceiling 32.

Housing 30 has an interior cavity 38 communicating with central floor opening 40. EAS marker 42 is disposed in housing interior cavity 38.

Housing 30 defines sidewall 44 extending from ceiling 32 to continuous peripheral floor portion 34*a* and tapered to form the housing with a periphery having a V-shaped cross-section, as is seen particularly in FIG. 8.

Bottom closure member 46, having arcuate undersurface 47, is secured to an interior surface of the floor continuous peripheral portion 34*a* as by an adhesive or heat sealing. An adhesive layer (not shown) is disposed on bottom closure member 46 and floor continuous peripheral portion 34*a*.

Figure 10:
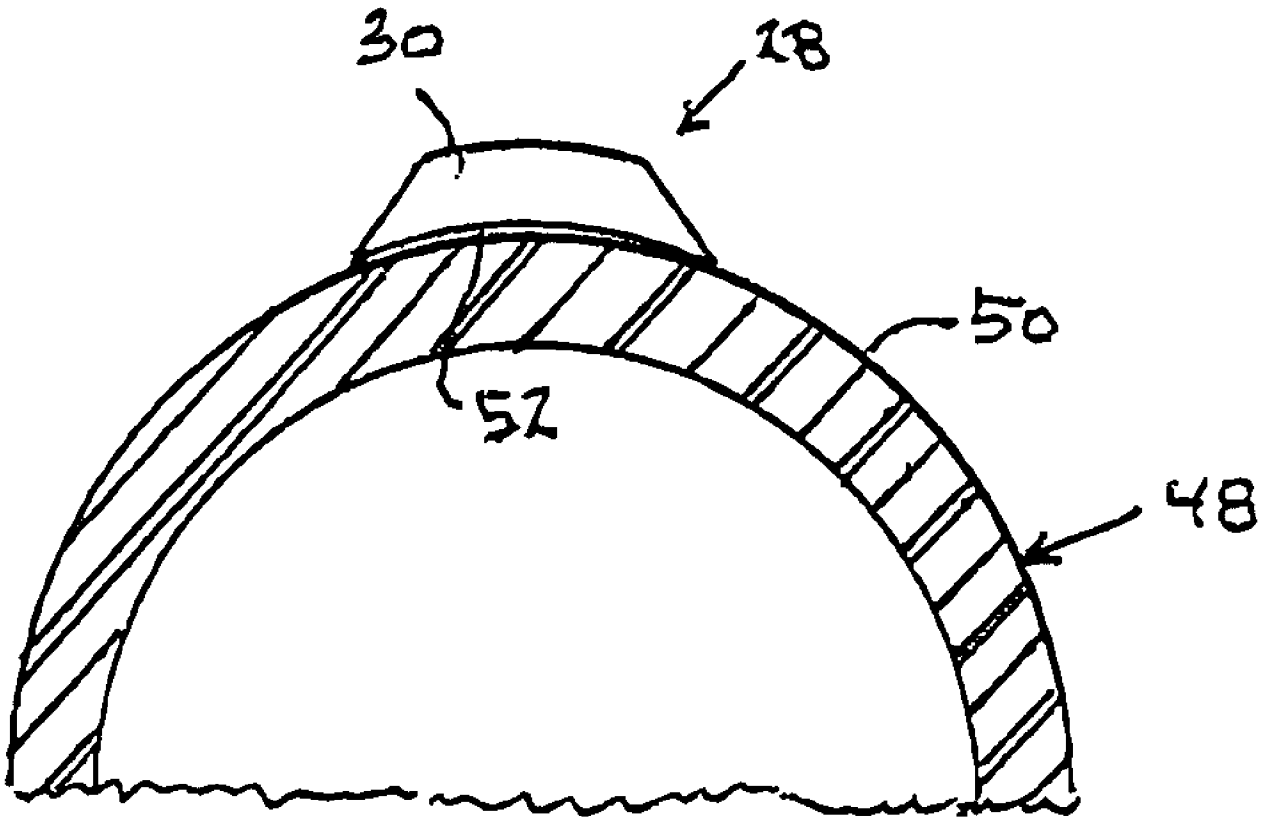
FIG. 10 is an enlarged, partial, sectional view of the EAS assembly of FIG. 6 with an article of manufacture.

Turning to FIG. 10, it depicts an enlarged, partial, sectional view of EAS assembly 28 of FIG. 6 with article of manufacture 48, which may be a wine bottle or like body having exterior arcuate surface 50. EAS assembly 28 has housing 30 with contained EAS marker 42 and its open floor closed by closure member 46. Adhesive 52 is disposed on the underside of closure member 46 and floor continuous peripheral portion 34*a* and secures assembly 28 to surface 50.

As will be appreciated, the continuous V-shaped exterior perimeter portion of assembly 28 provides a measure of resistance to prying the assembly from its attachment to surface 50.

Various changes may be introduced in the disclosed preferred embodiment without departing from the invention. By way of example, interior structure 28 effectively provides sufficient spacing between EAS marker 14 and metallic bottom portion 40 so that the EAS marker is isolated from influence of the metal. Accordingly, it is to be appreciated that the true spirit and scope of the invention is set forth in the following claims.

What is claimed is:

1. An electronic article surveillance assembly comprising an upstanding housing having a closed ceiling and a floor having a continuous peripheral portion bounding a central floor opening, said housing having an interior cavity communicating with said central floor opening, an EAS marker being disposed in said housing interior cavity, said housing defining a sidewall extending from said ceiling to said continuous peripheral floor portion and tapered to form said housing with a periphery having a V-shaped cross-section.

2. The electronic article surveillance assembly claimed in claim 1, further including a bottom closure member secured to an interior surface of said floor continuous peripheral portion.

3. The electronic article surveillance assembly claimed in claim 2, further including an adhesive layer disposed on said bottom closure member and said floor continuous peripheral portion.

4. The electronic article surveillance assembly claimed in claim 1, wherein said continuous floor peripheral portion is of arcuate configuration.

5. The electronic article surveillance assembly claimed in claim 4, wherein said ceiling is of common arcuate configuration with said continuous floor peripheral portion.

6. The electronic article surveillance assembly claimed in claim 5, further including a bottom closure member secured to an interior surface of said floor continuous peripheral portion, said bottom closure member being of common arcuate configuration with said continuous floor peripheral portion.

7. The electronic article surveillance assembly claimed in claim 6, further including an adhesive layer disposed on said bottom closure member and said floor continuous peripheral portion, said adhesive layer being of common arcuate configuration with said continuous floor peripheral portion.

8. In combination:

(a) an electronic article surveillance assembly comprising an upstanding housing having a closed ceiling and a floor having a continuous peripheral portion bounding a central floor opening, said housing having an interior cavity communicating with said central floor opening, an EAS marker being disposed in said housing interior cavity, said housing defining a sidewall extending from said ceiling to said continuous peripheral floor portion and tapered to form said housing with a periphery having a V-shaped cross-section; and (b) an article of manufacture, said continuous floor peripheral portion being secured to an exterior surface of said article of manufacture.

9. The invention claimed in claim 8, further including a bottom closure member secured to an interior surface of said floor continuous peripheral portion.

10. The invention claimed in claim 9, further including an adhesive layer disposed on said bottom closure member and said floor continuous peripheral portion.

11. The invention claimed in claim 8, wherein said exterior surface of said article of manufacture and said continuous floor peripheral portion are of common arcuate configuration.

12. The invention claimed in claim 11, wherein said ceiling is of common arcuate configuration with said continuous floor peripheral portion and said exterior surface of said article of manufacture.

13. The invention claimed in claim 12, further including a bottom closure member secured to an interior surface of said floor continuous peripheral portion, said bottom closure member being of common arcuate configuration with said continuous floor peripheral portion and said exterior surface of said article of manufacture.

14. The invention claimed in claim 13, further including an adhesive layer disposed on said bottom closure member and said floor continuous peripheral portion, said adhesive layer being of common arcuate configuration with said continuous floor peripheral portion and said exterior surface of said article of manufacture.

* * * * *